United States Patent [19]

Kastrup et al.

[11] 4,404,921

[45] Sep. 20, 1983

[54] BUTTONHOLE MACHINE WITH AUTOMATIC THREAD CLIPPING

[75] Inventors: Eberhard Kastrup; Heinz-Rolf Oberschelp, both of Bielefeld, Fed. Rep. of Germany

[73] Assignee: Dürkoppwerke GmbH, Bielefeld, Fed. Rep. of Germany

[21] Appl. No.: 393,472

[22] Filed: Jun. 29, 1982

[51] Int. Cl.[3] ..... D05B 65/02

[52] U.S. Cl. ..... 112/291; 112/296

[58] Field of Search ..... 112/291, 292, 296, 297, 112/253, 68

[56] References Cited

U.S. PATENT DOCUMENTS

| | | | |
|---|---|---|---|
| 1,743,356 | 1/1930 | Kiewicz | 112/291 |
| 1,988,460 | 1/1935 | Pikul | 112/291 X |
| 2,210,638 | 8/1940 | Spaine et al. | 112/291 |
| 2,324,235 | 7/1943 | Pikul | 112/291 X |
| 2,499,335 | 2/1950 | Spaine | 112/291 |

*Primary Examiner*—H. Hampton Hunter

*Attorney, Agent, or Firm*—Karl F. Ross; Herbert Dubno

[57] ABSTRACT

A buttonhole machine has a vertically reciprocal needle, a horizontally displaceable material support plate, a rotary stitch plate below the needle, mechanism for feeding a lower thread up through the stitch plate, clamps for holding material on the material plate at the stitch plate, and a drive for rotating the stitch plate in one rotational sense, simultaneously displacing the material plate, and reciprocating the needle to form a buttonhole in the fabric and for rotating it in an opposite return rotational sense after formation of the buttonhole. Such a machine also feeds an upper thread down through the needle to the stitching location and also normally lays a thick cording thread into the buttonhole to reinforce it. This machine is equipped with a feed arm carried by and jointly rotatable with the stitch plate, engaging the lower thread, and pivotal for freeing a length of the lower thread and feeding same to the stitch plate. A pivotal blade carried by the material plate can coact with a fixed blade on the material plate. The operation of this pivotal blade and arm is controlled by cams at least partially on the stitch plate for pivoting the blade during return rotation of the stitch plate to sever the lower thread and for synchronously pivoting the feed arm to make slack in the lower thread.

10 Claims, 4 Drawing Figures

BUTTONHOLE MACHINE WITH AUTOMATIC THREAD CLIPPING

FIELD OF THE INVENTION

The present invention relates to a machine for making buttonholes in textile material. More particularly this invention concerns such a machine which automatically clips the lower and cording threads of a buttonhole once it has been formed, either before or after the buttonhole has been cut.

BACKGROUND OF THE INVENTION

A standard buttonhole machine has a vertically reciprocal needle, a horizontally displaceable material support plate, a rotary stitch plate below the needle, means for feeding a lower thread up through the stitch plate, clamps for holding material on the material plate at the stitch plate, and means for rotating the stitch plate in one rotational sense, simultaneously displacing the material plate, and reciprocating the needle to form a buttonhole in the fabric and for rotating it in an opposite return rotational sense after formation of the buttonhole. Such a machine also feeds an upper thread down through the needle to the stitching location and also normally lays a thick cording thread into the buttonhole to reinforce it. The upper and lower threads pass through respective brakes that tension them.

Once such a buttonhole is formed the threads must all be cut. No loose ends should remain, so ideally tails a few centimeters long are left. These tails are tucked through the hole afterward and a solid bar tack closes the buttonhole and secures these tails in place to make a high-quality buttonhole.

Rather than do this clipping manually, a pneumatically powered apparatus is known which is attached to the material plate. It has a blade which cuts transversely across the cording and lower threads once the buttonhole is formed, normally with automatic actuation. Such a device is bulky, getting in the way when the machine is operated, and is relatively slow. In addition shops not disposing of compressed air normally are not willing to make the equipment investment to use such devices. Furthermore the cutters often leave thread tails that are too short, or they apply so much lateral pressure to these threads that they pucker the newly formed buttonhole.

OBJECTS OF THE INVENTION

It is therefore an object of the present invention to provide an improved buttonhole machine.

Another object is the provision of such a buttonhole machine which overcomes the above-given disadvantages.

Yet another object is to provide an improved thread-cutting arrangement for such a machine which operates automatically, takes up no useful room at or near the work surface, and which does not need an auxiliary source of power such as compressed air.

SUMMARY OF THE INVENTION

These objects are attained according to the instant invention in a buttonhole machine of the above-described general type, but equipped with a feed arm carried by and jointly rotatable with the stitch plate, engaging the lower thread, and pivotal for freeing a length of the lower thread and feeding same to the stitch plate. A pivotal blade carried by the material plate can coact with a fixed blade on the material plate. The operation of this pivotal blade and arm is controlled by cam means at least partially on the stitch plate for pivoting the blade during return rotation of the stitch plate to sever the lower thread and for synchronously pivoting the feed arm to make slack in the lower thread.

Thus the feed arm puts slack in the lower thread so that it can be pulled to the side and cut by the blades, leaving relatively long thread tails. No appreciable tension is put on the lower thread so that the buttonhole is not puckered by the clipping operation. Furthermore the clipping mechanism is wholly powered by and integrated into the sewing machine that makes the buttonholes so that it does not require a separate compressor or the like.

According to another feature of this invention a second cording thread is fed through the stitch plate and is incorporated in the button hole. The blade includes a two-part thread catcher and separator engageable with both of the threads. Thus both of the threads are cut by the blades.

The apparatus according to this invention further has a two-part thread clip on the material plate positioned to engage and hold both of the threads when the pivotal blade pushes same toward the fixed blade. With such a two-part clip a relatively thick cording thread as well as a normally relatively fine lower thread are easily both held.

The cam means according to this invention includes a pair of cam operators carried on the material plate, engageable with the feed arm, and effective only in the return rotational sense of the stitch plate to pivot the feed arm. This is accomplished by forming each cam operator as a support fixed on the material plate, and a pawl pivoted on the respective support in such a manner that when pushed in one direction it swings to the side, but when engaged in the other direction it does not. The feed lever has cam formations engageable with the respective pawls. These operators are angularly offset relative to the stitch plate and positioned to pivot the feed arm before the threads are cut and again after the threads are cut.

The pivotal blade according to the invention is formed with a thread-catching notch wide enough to engage both of the threads and the separator extends into the notch and subdivides same into respective parts for the threads. To this end the stitch plate is formed with a bump over which one of the threads passes so it is above the other.

The control means of this invention includes a cam fixed on the switch plate and a pusher arm carried on the material plate and having one end engageable with the pivotal blade and another end engageable with the cam. The pivotal blade is pivotal about a blade axis and is formed with a camming surface extending as a spiral to the axis and engageable by the one end of the pusher arm. This spiral shape is such that as the two blades approach each other they move ever more slowly, for sure cutting action with sufficient strength even to cut a relatively thick cording thread.

The material plate of this invention moves in a predetermined direction during rotation of the stitch plate in the return sense and the pivotal blade is displaceable transversely relative to the direction. This allows relatively lond thread tails to be left.

In addition the apparatus of this invention further has a thread brake below the stitch plate. The lower thread passes through the thread brake, then is gripped by the feed arm, and then passes through the stitch plate.

DESCRIPTION OF THE DRAWING

The above and other features and advantages will become more readily apparent from the following, reference being made to the accompanying drawing in which.

SPECIFIC DESCRIPTION

Figure 1:
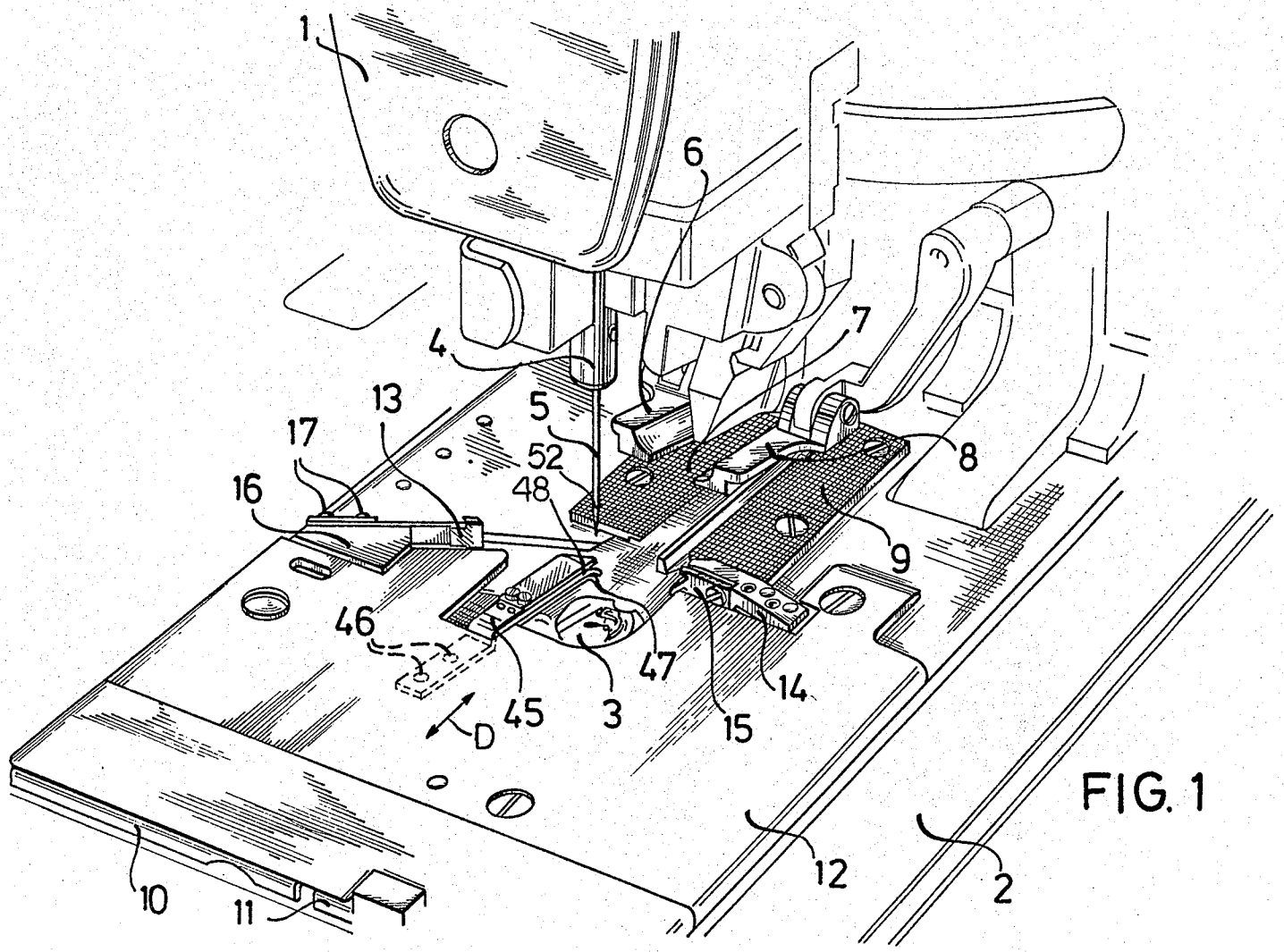
FIG. 1 is a perspective view of the apparatus according to this invention.

As seen in FIG. 1 a buttonhole machine according to this invention has a standard needle head 1 and a standard material-support plate 2. A stitch plate 3, a needle rod 4, a needle 5, a left upper material gripper 6, a left lower material gripper 7, a right upper material gripper 8, and a right lower material gripper 9 operate together in a manner well known in the art. The plate 2 is movable horizontally in and perpendicular to a material-displacement direction D, and carries left and right holding plates 10 and 11 as well as a cover plate 12 on top of the plates 10 and 11. This structure and its operation are all standard and do not need further discussion here.

Figure 2:
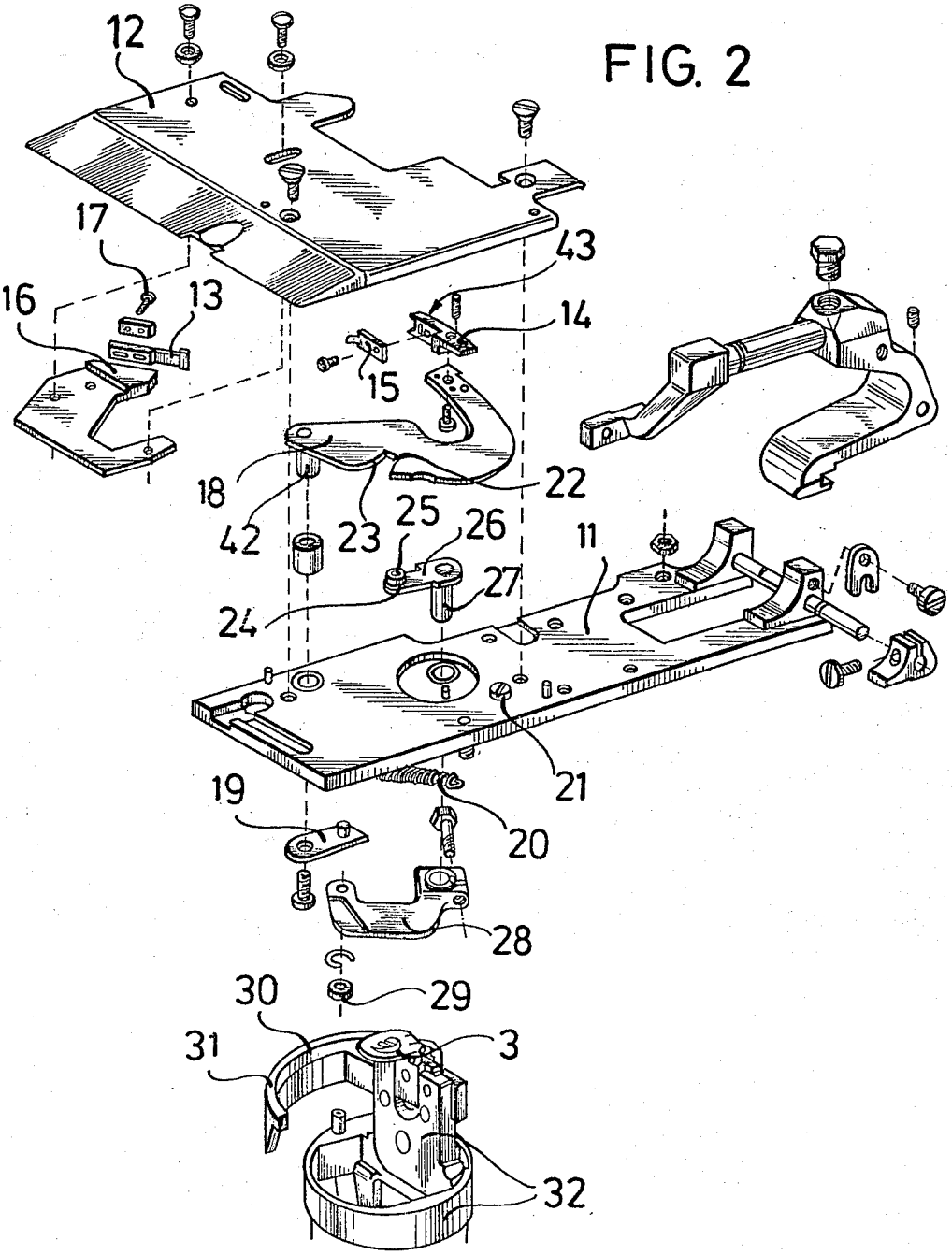
FIG. 2 is an exploded view of the critical parts of the apparatus of FIG. 1.

As also shown in FIG. 2, stationary blade 13 is secured by screws 17 to a support element 16 fixed to the plate 12 and coacts with the cutting edge 43 of a cutter/catcher element 14 also carrying a vertical thread separator 15 and itself mounted on an arm 18. A pivot pin 42 of this lever or arm 18 extends through a journal in the plate 11 and is provided on the bottom side of this plate 11 with another arm 19 over which is hooked a tension spring 20 that urges the arm 18 clockwise as seen from the top, that is into a position with the elements 13 and 14 spaced apart and the arm 18 resting against an abutment 21 fixed on the plate 11. This lever 18 is formed with a notch 22 defining a camming surface 23 of varying radial spacing from the pivot pin 42.

Another pivot pin 27 carries an arm 26 provided with a pin 25 carrying a cam roller 24 that is engageable radially relative to the axle pin 42 with the surface 22. The other end of this pivot pin 27 is clamped to amother cam-follower lever 28 provided with a roller 29 that rides on the inside surface 30 of a further cam 31 fixed to the support 32 for the stitch plate 3. This support 32 rotates as is well known during the formation of a button hole so all the stitches extend out from the hole.

Figure 3:
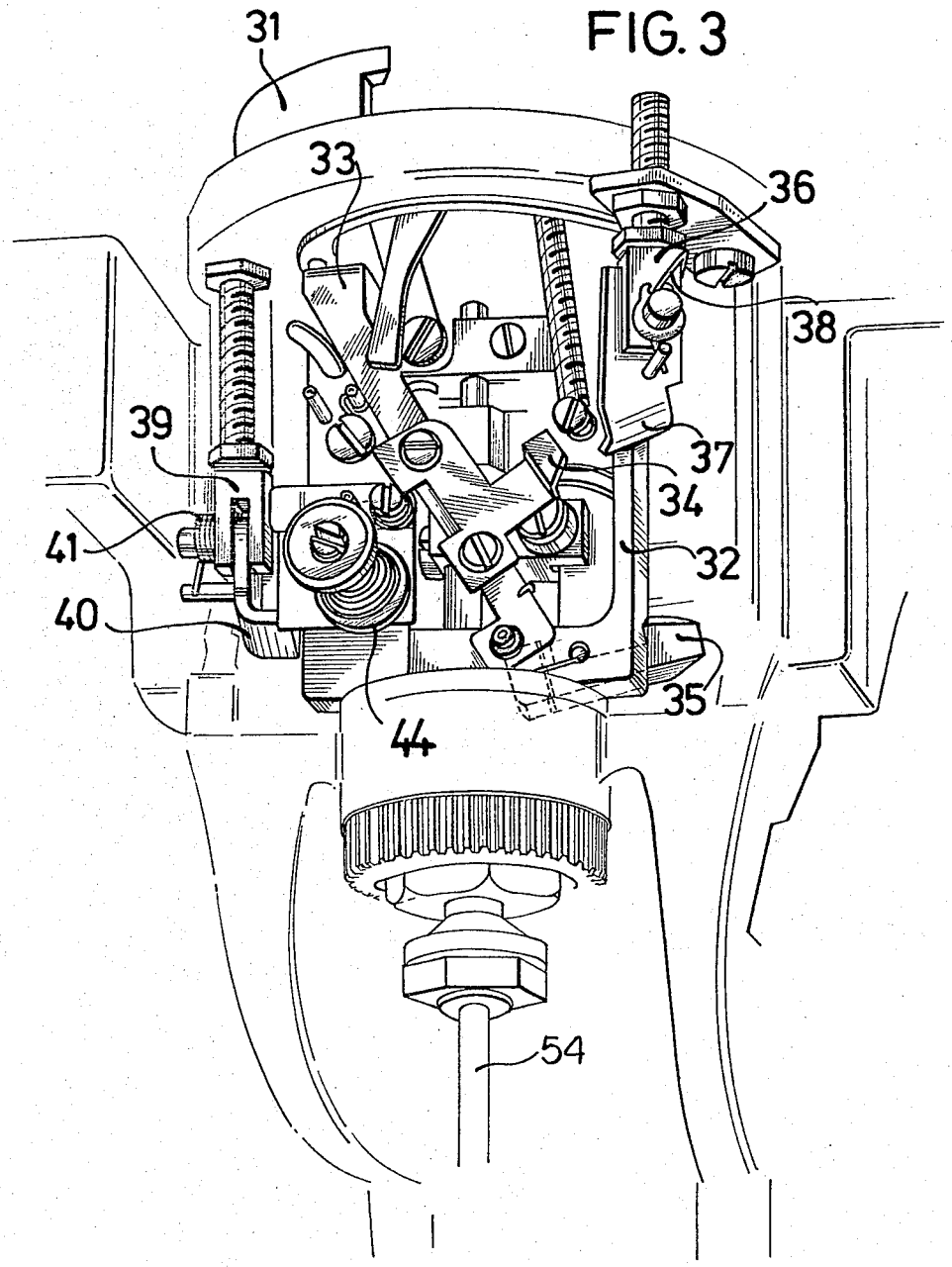
FIG. 3 is a perspective view from underneath of a portion of the mechanism of the apparatus of FIG. 1.

The support 32 is provided as seen in FIG. 3 with a pair of vertically adjustable but fixed pawl supports 36 and 30 provided with respective one-way cam/pawls 37 and 40 having respective torsion springs 38 and 41 that allow the cam/pawls 37 and 40 to be deflected as they move clockwise, seen from above, past respective cam extensions or actuator formations 34 and 35 of a standard thread-pulling lever 33 that is associated with a standard thread brake 44.

Figure 4:
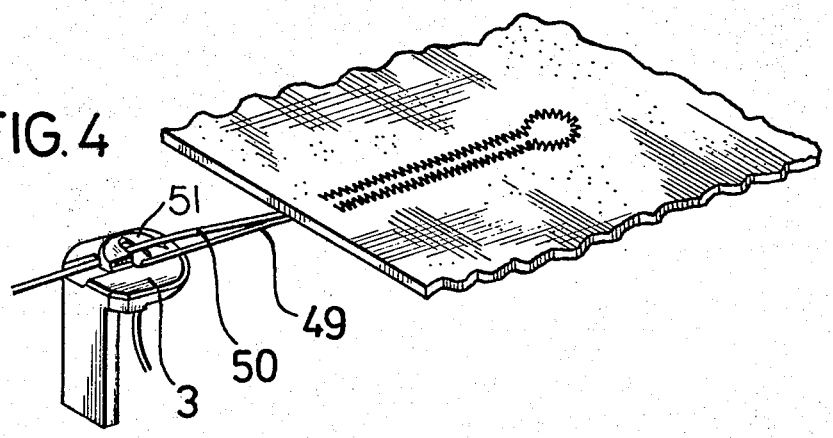
FIG. 4 is a perspective view illustrating a detail of the apparatus of this invention.

A double thread gripper 45 having lower and upper clips 47 and 48 for respective bobbin and inlay filaments or threads 49 and 50 is secured by screws 46 to the plate 12. The screws 46 pass through the plate 12 at a slot elongated in the direction D to allow adjustment of the position of this gripper 45. The stitch plate 3, as shown in FIG. 4, has a bump 51 so that the thicker inlay or cording thread 50 is above the bobbin or lower thread 49. The bobbin thread 49 itself is engaged by the arm 33 between the stitch plate 3 and the brake 44; pivoting of this arm 33 can pull a length of the thread 49 through the brake 44.

As is well known, during stitching the needle 5 is reciprocated vertically to stitch a needle or upper thread 52 with the lower thread 49, forming double-chain stitching around the cording 50. Meanwhile the plates 10–12 are moved in the direction D. At the end of the straight part of the first side of the buttonhole the plates 10–12 are moved slightly to one side, transverse to the direction, as the needle plate 3 with the cam 31 is rotated slowly counterclockwise through 180°. During the first 45° of such 180° rotation the plates 10–12 are moved simultaneously to one side and in the travel direction away from the stand of the machine. During the next 45° the transverse displacement is reversed, then during the next 45° the displacement in the direction D is reversed, and in the last 45° of rotation the transverse displacement is again reversed. This is standard and is carried out by devices 53 connected to the plates 11 and 12 and by a shaft 54 connected to the support 32. The result is a buttonhole of keyhole shape as shown in FIG. 4.

During such counterclockwise displacement of the support 32 the feed lever 33 passes over the pawls 37 and 40, deflecting them on their supports 36 and 39 so that they do not pivot the arm 33.

According to this invention at the end of the formation of a buttonhole, preferably of the keyhole shape shown in FIG. 4 and whose stitching is described above, the needle and the gripper are stationary and the clamps 6 and 7 still press the goods to either side of the stitched button hole down against the lower plates 7 and 9, respectively. Normally the plate 2 moves back in the direction D toward the back of the machine (generally toward the right in FIGS. 2 and 4) through a certain distance to leave tails of the threads 49 and 50 hanging from the buttonhole just formed, the needle thread 52 having been clipped in the standared manner. At the same time the needle rod 4 and support 32 must rotate back clockwise through 180° to return to the proper starting position for the next buttonhole.

During this clockwise return rotation the camming projection 35 engages the inclined face of the pawl 40, which when pushed in this direction does not pivot itself, but forces the thread-pulling lever 33 to pivot. This action pulls a length of the bobbin thread 49 through the brake 44 so that as the plate 2 moves back this thread 49 is loose. As a result the newly stitched hole is not deformed by having the lower thread 49 pulled tight.

At the same time the roller 29 engages the inner surface 30 of the cam formation 31, which surface is generally spiral shaped relative to the rotation axis defined by the shaft 54 so that the levers 28 and 26 are pivoted against the force of the spring 20. This action first engages the two threads on the catcher 14 to opposite vertical sides of the catcher, with the thick cording 50 above the bobbin thread 49. The thread 49 has already been let out by the arm 33 so the catcher 14 is not pushing against the brake 44 and tensioning this thread 49 to pucker the buttonhole as mentioned above. The cording 50 is under very modest tension and is securely anchored in the goods so that the catcher 14 can push it without deformation of the work.

As the catcher 14 pushes the two threads 49 and 50 transverse to the direction D, it catches the lower thread 49 in the lower clip 47 an the upper thread 50 in the clip 48 and thereafter pushes the threads 49 and 50 against the blade 13, cutting them through. As they are cut the amount of the thread 49 that has been pulled through the brake 44 by the arm 33 as its cam formation 35 is actuated by the cam 40 is used up. Thus these threads 49 and 50 are under slight tension as they are cut, since it is virtually impossible to clip them when they are slack. This action leaves tails 3 cm–4 cm long of the threads 49 and 50 hanging from the finished buttonhole.

Then, once the cutter/catcher arm 14 has come to the end of its angular stroke, when the cutting edge 43 engages the blade 13 and severs the thread 49 and 50, the other cam projection 34 of the payout arm 33 engages the respective actuator pawl 37 to swing this arm 33 against the force of its return spring and pull out another short length of the thread 49. The arm 14 is returned by the spring 20 since the roller 29 has reached the end of the track 30 and the plates 2 and 10–12 continue to move back. During this return slide of these plates the slack just created in the thread 49 ensures that it will not pull out of the respective clip 47.

At the start of the next buttonhole the plate 2 first moves forward into the sewing position, which action also displaces the double gripper 45 forwardly to pull away from the stationary support 32 of the stitch plate 3. Obviously during this starting motion the slack in the thread 49 once again prevents it from pulling out of the clip 47. Thus at the start of the operation the threads 49 and 50 will be in the perfect starting position, held there by the double gipper 45.

The system of the instant invention therefore automatically clips the two threads 49 and 50, leaving a tail sufficiently long to tuck through the hole, which may have been cut before after the buttonhole is sewn. The cut-off threads are left clipped in the double gripper 45. Thus, the machine automatically ends the one operation and sets itself up perfectly to start the next one.

We claim:

1. In a buttonhole machine having:

a vertically reciprocal needle;

a horizontally displaceable material support plate;

a rotary stitch plate below said needle;

means for feeding a lower thread up through said stitch plate;

clamps for holding material on said material plate at said stitch plate; and means for rotating said stitch plate in one rotational sense, simultaneously displacing said material plate, and reciprocating said needle to form a buttonhole in said fabric and for rotating it in an opposite return rotational sense after formation of the buttonhole; the improvement comprising:

means including a feed arm carried by and jointly rotatable with said stitch plate, engaging said lower thread, and pivotal for freeing a length of said lower thread and feeding same to said stitch plate;

a pivotal blade carried by said material plate;

a fixed blade on said material plate and engageable with said pivotal blade; and control cam means at least partially on said stitch plate for pivoting said blade during return rotation of said stitch plate to sever said lower thread and for synchronously pivoting said feed arm to make slack in said lower thread.

2. The improvement defined in claim 1 wherein a second cording thread is fed through said stitch plate and is incorporated in said button hole, said blade including a two-part thread catcher and separator engageable with both of said threads, whereby both of said threads are cut by said blades.

3. The improvement defined in claim 2, further comprising a two-part thread clip on said material plate positioned to engage and hold both of said threads when said pivotal blade pushes same toward said fixed blade.

4. The improvement defined in claim 3 wherein said cam means includes a pair of cam operators carried on said material plate, engageable with said feed arm, and effective only in the return rotational sense of said stitch plate to pivot said feed arm.

5. The improvement defined in claim 4 wherein said operators are angularly offset relative to said stitch plate and positioned to pivot said feed arm before said threads are cut and again after said threads are cut.

6. The improvement defined in claim 5 wherein said pivotal blade is formed with a thread-catching notch wide enough to engage both of said threads and said separator extends into said notch and subdivides same into respective parts for said threads.

7. The improvement defined in claim 4 wherein said control means includes a cam fixed on said switch plate and a pusher arm carried on said material plate and having one end engageable with said pivotal blade and another end engageable with said cam.

8. The improvement defined in claim 5 wherein said pivotal blade is pivotal about a blade axis and is formed with a camming surface extending as a spiral to said axis and engageable by said one end of said pusher arm.

9. The improvement defined in claim 5 wherein said material plates moves in a predetermined direction during rotation of said stitch plate in said return sense, said pivotal blade being displaceable transversely relative to said direction.

10. The improvement defined in claim 5, further comprising a thread brake below said stitch plate, said lower thread passing through said thread brake, then being gripped by said feed arm, and then passing through said stitch plate.

* * * * *